United States Patent [19]

Roch

[11] 4,030,527

[45] June 21, 1977

[54] AUTOMATIC CABLE FORMING SYSTEM

[75] Inventor: Jacques L. Roch, San Jose, Calif.

[73] Assignee: Xynetics, Inc., Santa Clara, Calif.

[22] Filed: June 21, 1976

[21] Appl. No.: 698,184

[52] U.S. Cl. ..... 140/92.1; 140/93 R; 29/56.5; 29/755

[51] Int. Cl.[2] ..... B21F 27/00; H01R 43/00

[58] Field of Search ..... 140/92.1, 93 R; 29/203 B, 203 MW, 625; 242/129.2

[56] References Cited

UNITED STATES PATENTS

| | | | |
|---|---|---|---|
| 209,144 | 10/1878 | Storle | 242/129.2 |
| 3,485,458 | 12/1969 | Evans | 242/157 R |
| 3,804,130 | 4/1974 | Tarbox, et al. | 140/93 R |
| 3,907,007 | 9/1975 | Hobbs et al. | 140/93 R |
| 3,930,524 | 1/1976 | Tarbox | 140/93 R |
| 3,947,943 | 4/1976 | Kokubo, et al. | 140/92.1 |

*Primary Examiner*—Lowell A. Larson
*Attorney, Agent, or Firm*—Charles H. Schwartz

[57] ABSTRACT

An automatic cable forming system incorporating an X-Y positioner for automatically laying a plurality of individual wires in a predetermined pattern to form a complex cable and including an array of individual spools each including a tensioning device to produce a predetermined tension on a wire as it is unspooled and to take up any slack in the wire. The system also includes a plurality of individual capstan pulleys each receiving an individual wire from one of the spools and with a single capstan drive for engaging one capstan pulley at a time for individually feeding the plurality of wires from the spools. The wires pass to a plurality of individual clamps for clamping the plurality of individual wires except the wire fed from the capstan pulley engaged by the capstan drive, and with a wire feed mechanism intermediate the capstan drive and the clamps for feeding the wires to a single wire head. The head is coupled to the X-Y positioner for receiving the wire fed from the capstan pulley engaged by the capstan drive for laying the wire in a predetermined pattern and with a single wire head individually receiving each one of the plurality of wires as each wire is fed from its capstan pulley for laying the plurality of wires in the predetermined pattern to form the complex cable. The wire head includes a roller to engage the wire feed mechanism to feed the wire through the wire head to have its end clamped by end clamps before laying the wire. The wire head also includes an internal clamp, a cutter and a wire presence sensor. The wire head also has a feed tube mounted on a rocker assembly.

51 Claims, 16 Drawing Figures

FIG. 2
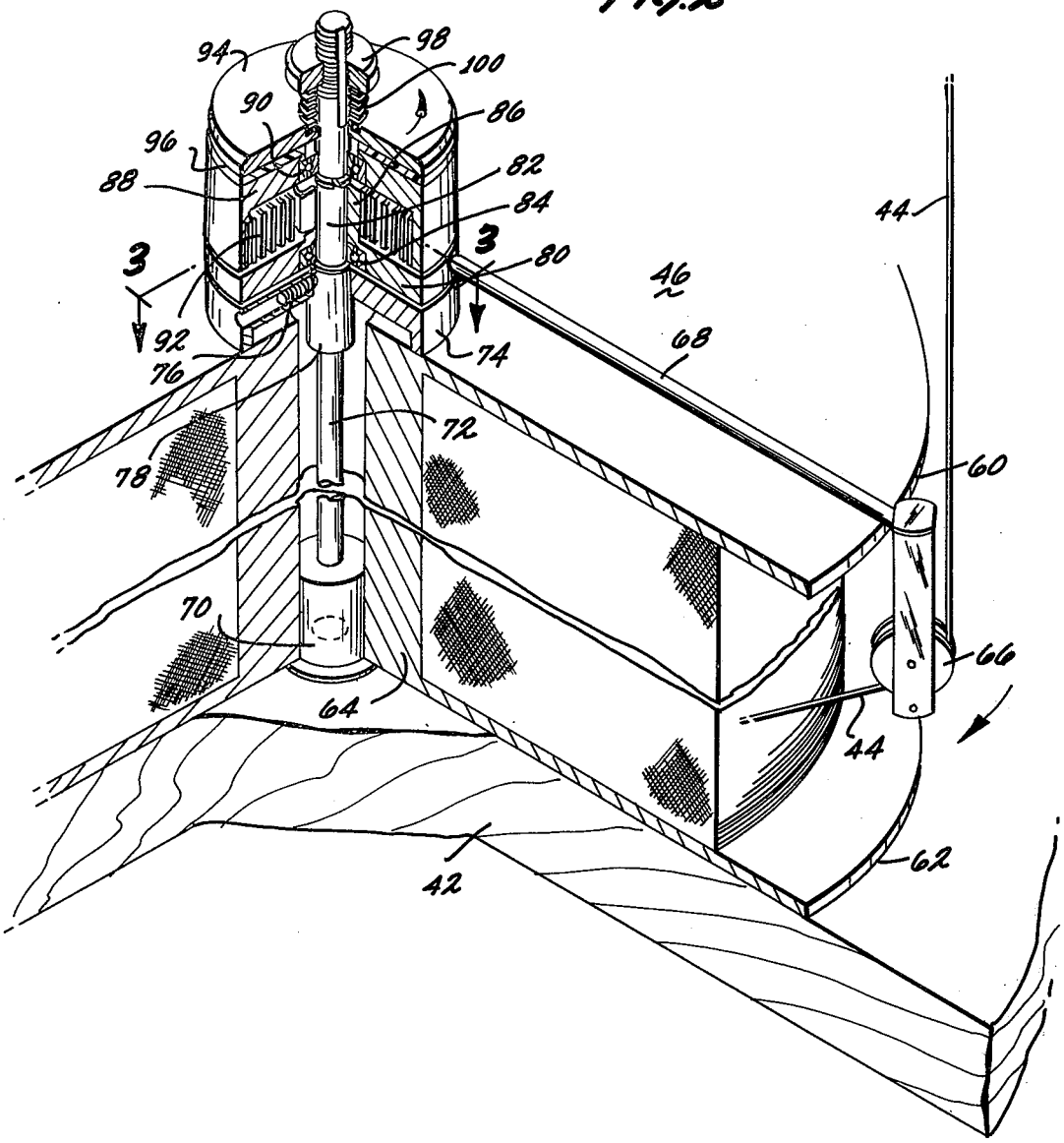
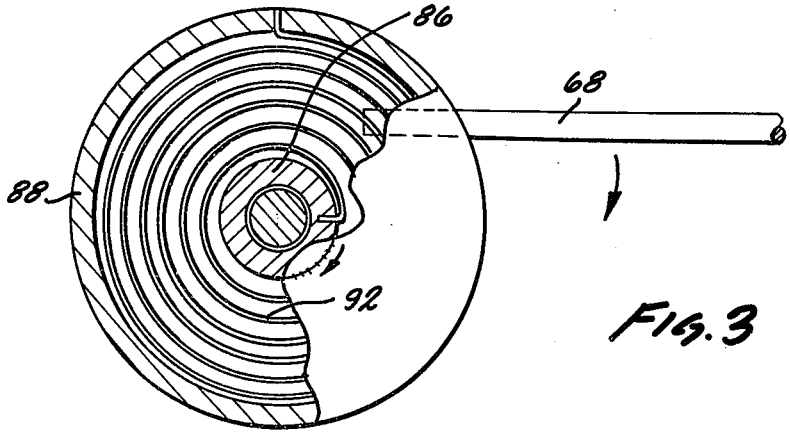
FIG. 3

AUTOMATIC CABLE FORMING SYSTEM

The present invention is directed to an automatic cable forming system using an X-Y positioner for automatically laying a plurality of individual wires in a predetermined pattern to form a complex cable.

It is often desirable in the electronics, aviation and aerospace industries to form complex cables for use in interconnecting various portions of sophisticated electrical and electronic systems. These cables are often formed entirely by hand using a form board to guide the laying of the individual ones of the wires into the specific cable design. The form board is generally structured of a large flat sheet of material, such as plywood, into which either pins or nails are inserted in a desired configuration conforming to the particular configuration for the individual wires which form the cable.

It is to be appreciated that as the complexity of the cable increases and the numbers of wires in the cable increase, the chances for human error in the forming of the cable also increase. Because a single error in a complex cable is difficult to find and time consuming to correct, it becomes more imperative to design a system to automatically form cables to eliminate this human error.

It has be proposed in the past to automate cable forming by using an X-Y positioner to carry individual wires along the form board in a predetermined path to lay lengths of each individual wire in accordance with a predetermined program. A number of such systems have been devised and have enjoyed some success in automatically forming cables. These systems, however, have had some difficulties in forming cables wherein a large number of individual wires are to be used in forming the cable, and with this large number of individual wires formed into the cable at a relatively high speed. It is, of course important to lay the individual wires at relatively high speeds to form the cables quickly, since the automatic cable forming systems are relatively expensive in cost. In order to justify the expense of the automatic cable forming system, the system should not only eliminate the human error but should also increase the efficiency of cable forming so as to provide a cost saving in addition to an error reduction.

Some of the prior art systems used a plurality of individual spools for individual wires and with all of the spools carried by the X-Y positioner. These cable forming machines have several disadvantages since the number of spools and hence the number of individual wires is limited, and the speed at which the machine can operate is also limited because of the additional mass which the machine must move during the laying of the individual wires. Other prior art machines have a plurality of spools to the side of the machine so that the spools are not carried by the X-Y positioner. These spools are generally rigidly aligned in an array which again limits the number of spools and hence the number of individual wires which the machine can use in its forming operation. Many of the prior machines also used a plurality of wire feed heads such as one for each wire which increases the mass which the X-Y positioner moves during the laying of the wires and thereby reduces the speed of operation. The present invention is an improvement over the prior art machines and provides for the laying of a plurality of individual wires at relatively high speed with flexibility of operation so as to automatically form cables in accordance with a predetermined program.

The present invention is directed specifically to an automatic cable forming system which may operate using a very large number of individual wires by which to form a cable. The invention provides for a relatively fast speed of operation so as to produce the automatically formed cables at a rapid rate and the system has great flexibility in both programming and operation. The automatic cable forming system of the present invention uses a plurality of spools which are arranged in a flexible array and with the individual spools positioned on pallets and with the wires guided over a frame assembly to the wire forming machine. The number of spools which may be used can be increased by adding additional pallets and frame assemblies so that the system can be expanded to accommodate a great number of individual wires to form the cables. Each spool includes spring tensioning means to provide for each individual wire being paid out under a predetermined tension and with the spring tensioning means providing for respooling of excess wire as the X-Y positioner moves back towards the array of spools after each wire has been laid over its predetermined path.

The individual wires extend from the frame assembly to a capstan assembly and then extend downward through a wire feed and clamp assembly. Individual wires may then be fed to a bar clamp assembly or the individual wires may be clamped by additional clamping means located on the form board.

Individual ones of the wires may be laid by an X-Y positioner on the form board to produce a preprogrammed configuration for each wire. Initially each wire is picked up by a wire head and is clamped by bar clamp before the wire is wrapped around a starting pin located on the form board. The wire is then fed directly from the capstan assembly through the wire head and is laid out around pins on the form board in accordance with a predetermined pattern. After the wire has been laid out over its complete programmed path, the individual wire is cut and then returned to the wire feed and clamp assembly to be reclamped in its original position. The wire head may then proceed to the next individual wire position to pick up a second individual wire and the process is repeated continuously until all the individual wires have been laid out along their programmed paths by the wire head. The system of the present invention uses only a single wire head so as to reduce the overall cost and to reduce the mass which must be carried by the X-Y positioner so that the X-Y positioner may move at a rapid speed.

The automatic cable forming system of the present invention has several advantages over the prior art systems. Since the wire spools or reels are individually positioned in an array, individual ones of the spools may be replaced or a new spool substituted for an old spool and any number of spools may be added without changing the existing position or arrangement of the spools already in position. This allows great flexibility for changing wires or adding wires and such changes may be made without disturbing all of the other spools. Each spool includes a spring mechanism which maintains a constant tension on the wire as it is being laid and allows for the wire to be respooled at the completion of the laying of an individual length of wire. Each wire is individually wrapped over a separate capstan and only one capstan at a time is engaged so as to eliminate the possibility of wires being fouled because of a number of capstans being engaged at the same time. All of the wires except the one actually being laid on the form board are held in a clamped position which is completely separate from the wire head, so that again there is no possibility of wires being fouled, or an improper wire being used.

The present invention uses a wire head which serves a number of functions. Specifically the wire head is used to release an individual wire from its clamped position and with the end of the individual wire then fed through the wire head to be clamped at a second position. This locks the end of the wire so that the wire may be fed directly from the capstan through the wire head as the wire head is moved away from the capstan and over the form board. After the individual wire has been laid over its entire programmed path, the wire is clamped within the wire head and cut and the wire head is returned to its initial position so that the wire may be reclamped before the wire head moves on to pick up the next individual wire.

The wire head of the present invention may include a swivel end so that the wire will follow the various changes in direction as the wire head moves over the form board. In addition, the wire head may include a Z position adjustment to compensate for different heights of form boards and different heights of pins extending from the form board and the Z position may be changed during the laying of the cable to compensate for the increasing height of the cable as the cable is being formed.

A clearer understanding of the invention will be had with reference to the following description and drawings wherein FIG. 1 is an overall perspective view of an automatic cable forming system of the present invention.

FIG. 2 is a detailed drawing of a spool assembly including a tension spring and wire return subassembly used with the automatic cable forming system of the present invention.

FIG. 3 is a detail of the spring subassembly taken along lines 3—3 of FIG. 2.

Figures 11, 11A:
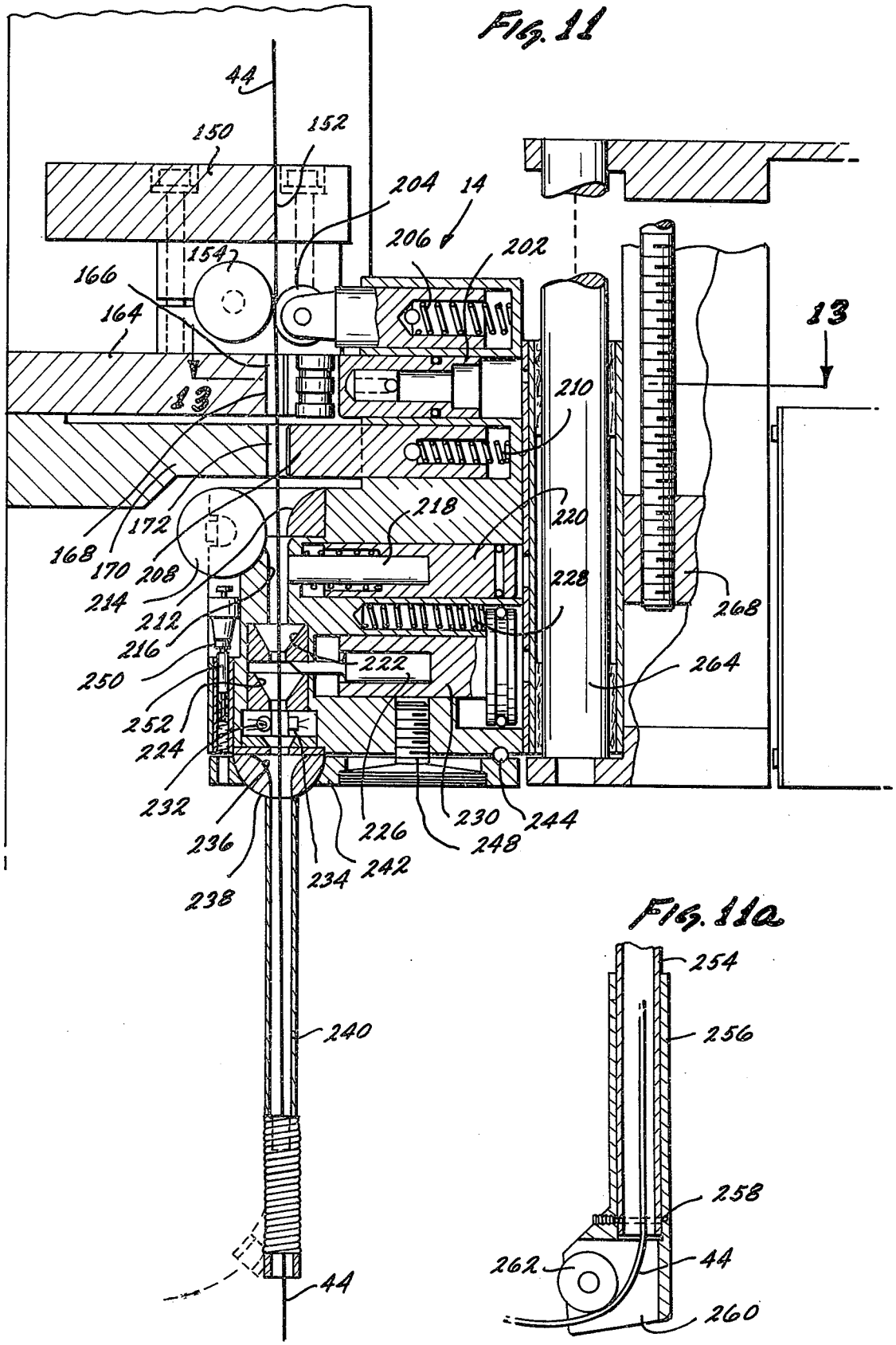
FIG. 11 is a detail cross-sectional view of the wire head engaging the wire feed and clamp assembly.

FIG. 11*a* is an alternative form of wire feeding tube having a swivel end with a roller.

Figure 12:
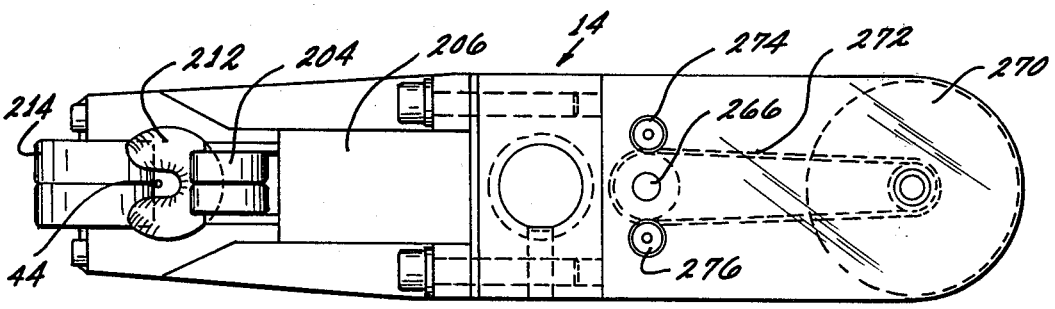

FIG. 12 is a top view of the wire head of FIG. 11.

Figure 13:
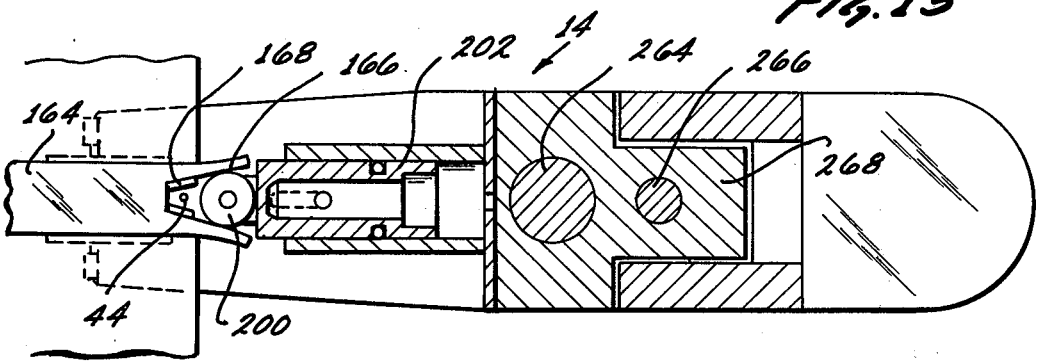

FIG. 13 is a cross-sectional view of the wire head taken along lines 13—13 of FIG. 11.

Figure 4:
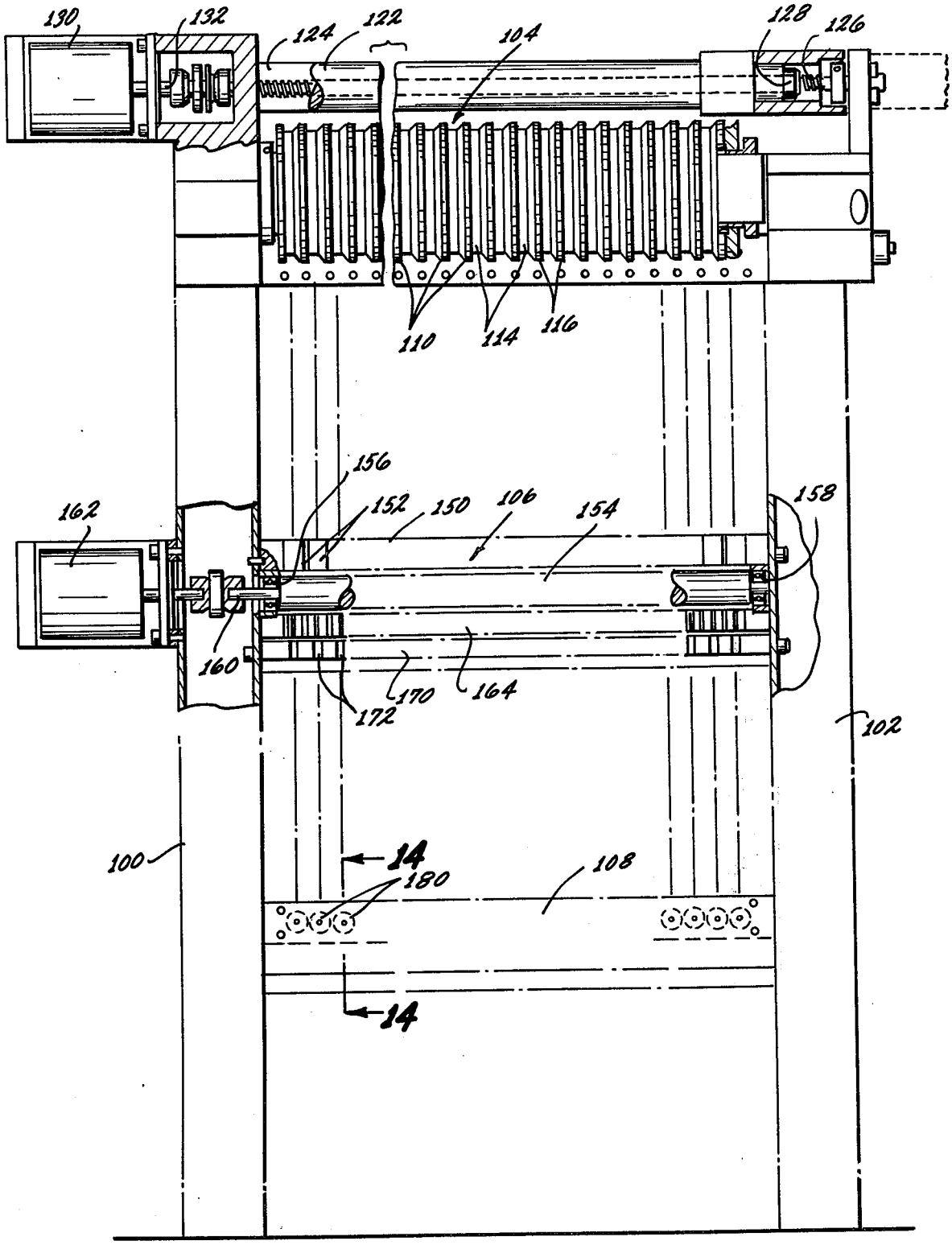
FIG. 4 is a front view of the capstan assembly, the wire feed and clamp assembly, and the wire bar clamp assembly positioned intermediate the X-Y positioner and the spool array.
Figure 14:
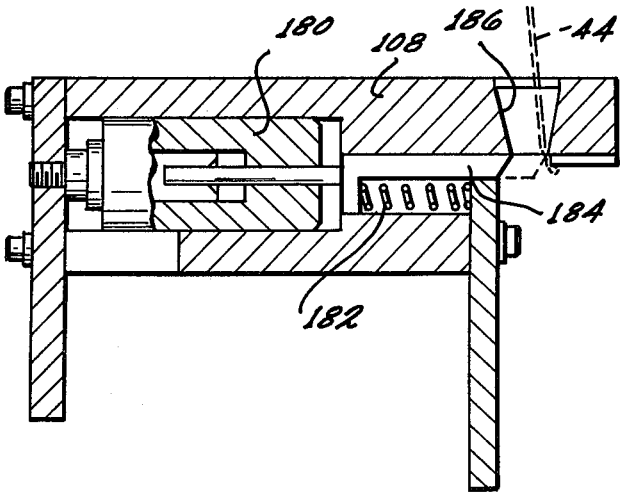
Figure 15:
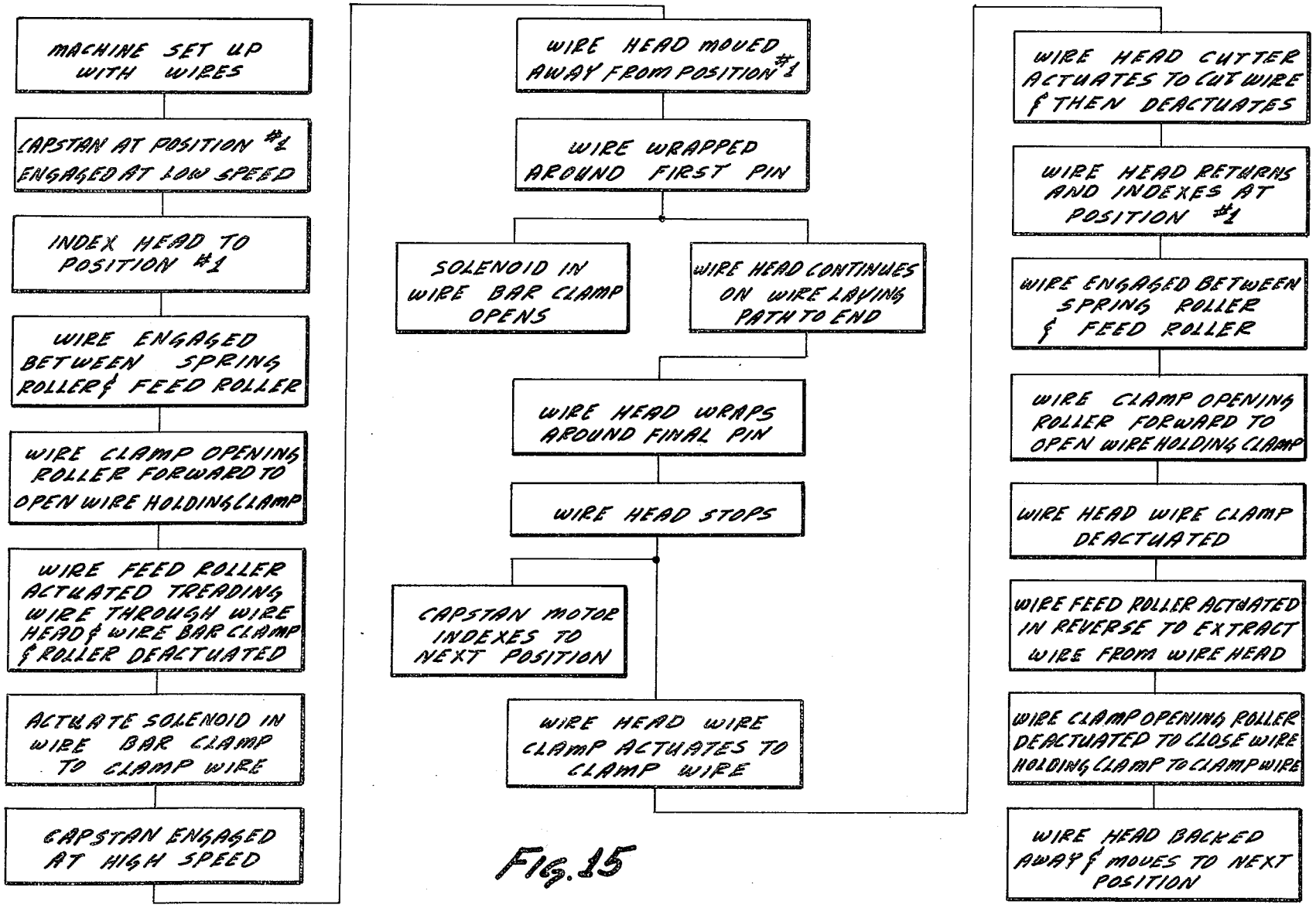

FIG. 14 is a detail cross-sectional view of the wire bar clamp assembly taken along lines 14—14 of FIG. 4; and FIG. 15 is a block diagram of a flow chart showing the operation of the programmer for controlling the automatic cable forming system of the present invention.

Figure 1:
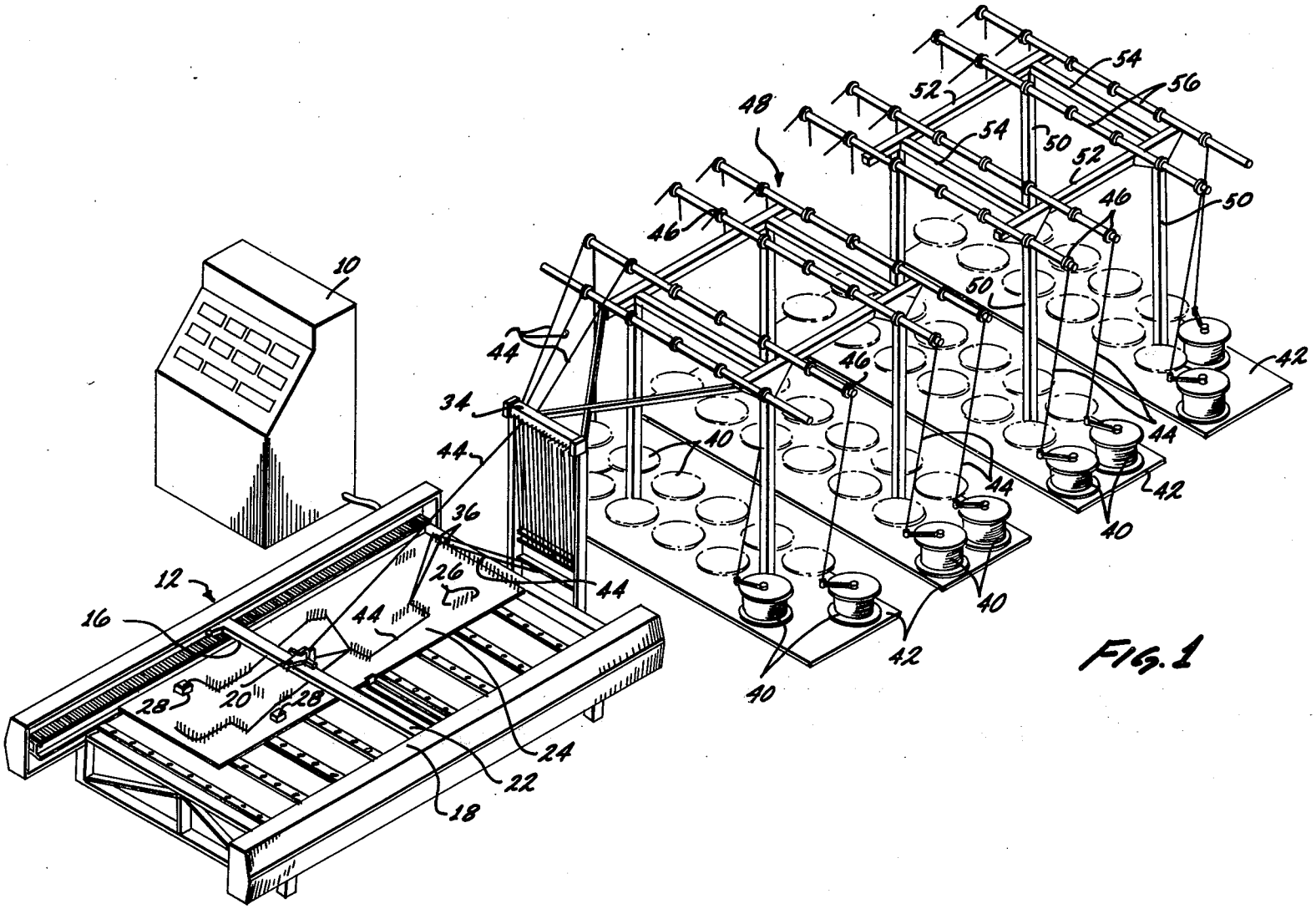

In FIG. 1, the general layout of the automatic cable forming system of the present invention is shown. The system includes a programmer 10 for controlling the operation of an X-Y positioner 12 and a wire laying head 14 in accordance with a preprogrammed series of instructions. The X-Y positioner 12 may consist of a pair of linear reluctance motors 16 and 18 to provide for motion in the X direction and a single linear reluctance motor 20 to provide for motion in the Y direction. It is to be appreciated that the type of X-Y positioner used in the present invention may be of any type currently in use and basically the structure consists of a beam 22 which is moved in an X direction and with the wire dispensing head 14 moved in a Y direction along the beam.

A form board 24, which includes a plurality of pins 26 arranged on the board in a predetermined pattern, is used to support individual wires such as wire 44 in the proper position after being laid on the form board 24 by the wire head 14.

As can be seen in FIG. 1, the individual wires 44 extend from spools of wire 40 around pulleys 46 and through a capstan assembly 34. The individual wires then pass through the head 14 and follow the particular pattern of pins 26 on the board 24 individual to each wire. A plurality of first pins 36 may be used as starting points and each wire 44 is initially wrapped around one of the pins 36 after having been clamped in the wire bar clamp assembly 38. The wire head 14 then lays the wire 44 on the form board in accordance with the predetermined pattern and the wires 44 are held in position by the particular pins 26 which relate to the pattern of the individual wire being laid.

In addition to or in lieu of the wire bar clamp 38, the form board 24 may contain individual clamps 28 to clamp the wire before laying the wire in the predetermined pattern. In that case, one of the pins 26 and even the pin 36 may be used as the last pin and with the wire wrapped around the last pin before cutting the wire and returning the wire to its original position.

As can be seen in FIG. 1, a plurality of spools 40 individually contain individual ones of the wires and with the spools laid in accordance with a predetermined array on pallets 42. Any number of additional pallets may be used so as to increase the number of individual wires used to form the cable. Also, individual ones of the spools may be removed and replaced with other spools without disturbing the remaining spools. The system of the present invention allows for a great deal of flexibility in setting up the desired number of spools, and in arranging for replacements or renewals of spools of individual wires. The spools 40 dispense the individual wires 44 which wires pass over individual pulleys 46. The pulleys 40 are supported by a frame assembly 48 including upright members 50, cross bars 52 and 54, and pulley supporting rods 56.

In FIGS. 2 and 3 are shown details of the spool assemblies 40 shown in FIG. 1. Each spool 40 includes a top plate 60 and a bottom plate 62, both extending from and integral with a hub portion 64. The spool of wire is wound on the hub 64 and in between the top and bottom plates. The wire 44 extends out and around a pulley member 66 contained at the end of a rotary arm 68. The pulley 66 is set at a small angle relative to the arm 68 so that the wire 44 as it comes off the spool is substantially in line with the pulley 66.

The hub member 64 sits over a nut 70 flush with spool member 62 and receives a threaded rod or shaft 72. The threaded rod 72 is held in place in member 78. A collar portion 74 is positioned on the upper surface of the spool 40 and is held in place with member 78 using a set screw or any other means. Tightening the nut 70 clamps the collar 74 on to the upper surface of the spool so as to prevent rotation of the collar 74.

The arm 68 extends from a lower housing member 80 which housing member is rotatable about a portion 82 of the shaft 72 using ball bearings 84. The lower housing 80 includes an integral right angle portion 86 which is concentric about the portion 82 of the shaft 72. Complementary to the lower housing 80 is an upper housing 88 which is also formed from two portions perpendicular to each other. The upper housing 88 is rotatable about the shaft 72 through the use of ball bearings 90.

A spiral spring 92 is attached at its ends to the upper housing and lower housing as shown in FIG. 3. As the arm 68 rotates, the spring 92 is wound up since the upper housing 88 remains stationary until a predetermined load is exceeded. When this predetermined load is exceeded, the upper housing rotates with the lower housing but with the spring 92 being maintained in its partially wound state. The predetermined load to which the spring may be wound before the upper housing rotates with the lower housing is determined through the use of a pressure plate 94 which engages the upper housing 88 through a washer 96. The washer 96 may be made of a material such as teflon which has a static and dynamic friction very close to each other. In this way the load that is required to overcome the static friction is substantially the same as the load which is required to maintain a sliding relationship between the upper housing and the pressure plate 94. The predetermined load which is required before the upper housing rotates with the lower housing is preset by a nut member 98 which controls the force exerted by a helical spring 100 against the pressure plate 94.

As the wire 44 is initially unreeled from the spool, the arm 68 moves in a clockwise direction. This partially winds the spring 92 since the lower housing 80 initially moves relative to the upper housing 88 because the upper housing is friction loaded by the pressure plate 94. When the spring is wound so that the predetermined load is exceeded, both the upper and lower housings rotate together relative to the pressure plate 94. When there is any slack in the wire 44, the spring is allowed to unwind so that the arm 68 will be immediately pulled in a counterclockwise direction to take up the slack. Specifically, when the wire head 14, as shown in FIG. 1, moves back towards the array of spools 40 after the individual wire has been laid over it entire programmed path, the slack in the wire 44 is taken up by the relative movement between the upper and lower housings which occurs as the spring 92 unwinds.

Figure 5:
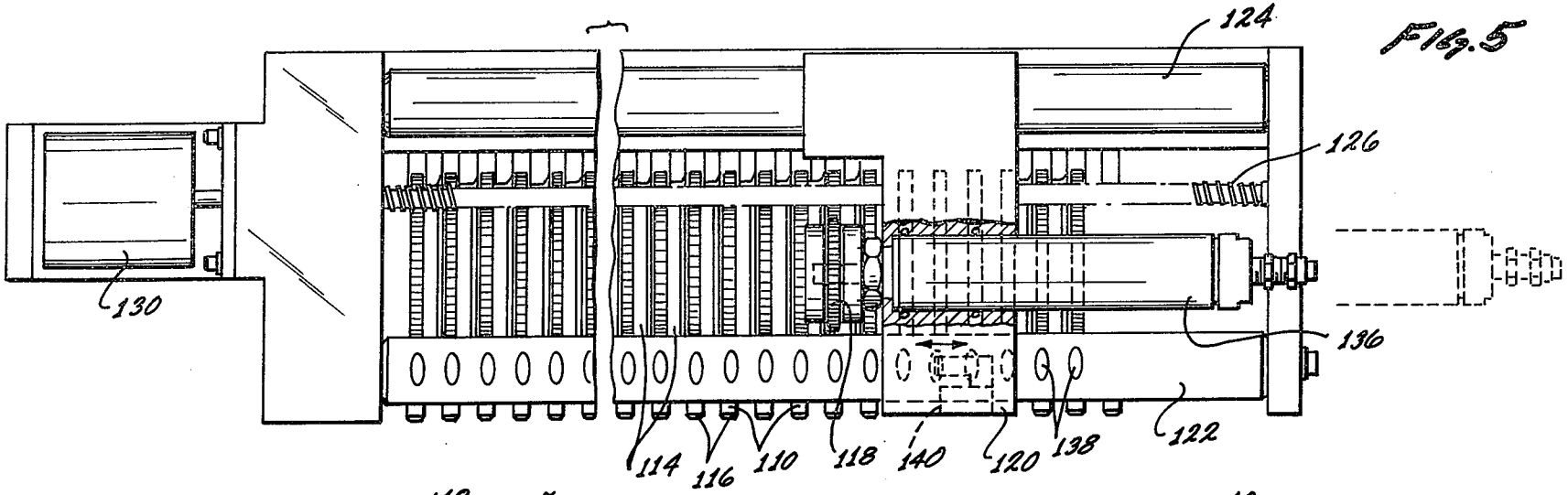
FIG. 5 is a top view of the capstan assembly.
Figure 6:
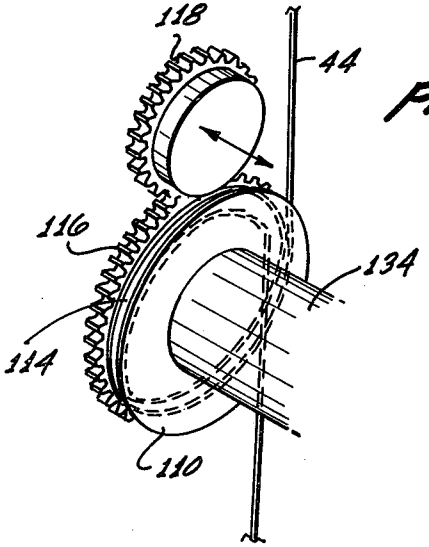
FIG. 6 is a detail view of a single capstan engaged by the capstan drive gear.

FIG. 4 illustrates a front view of the frame structure located intermediate the X-Y positioner and the spool array for supporting the plurality of individual wires for pick up by the wire head. The frame structure includes a pair of upright frame members 100 and 102 for supporting a capstan assembly 104, a wire feed and clamp assembly 106 and a wire bar clamp assembly 108. The capstan assembly is additionally seen in FIGS. 5, 6, and 7.

Figure 7:
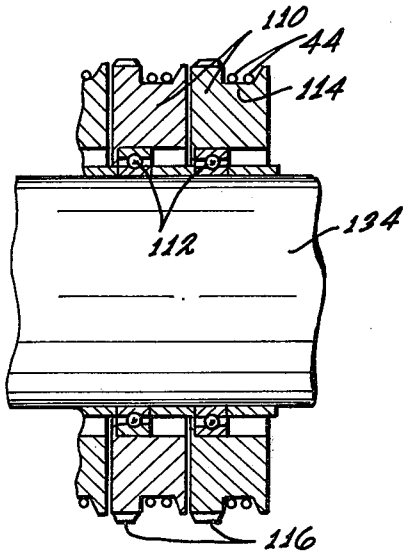
FIG. 7 is a detail cross-sectional view of a portion of the capstan assembly.

The capstan assembly 104 includes a plurality of individual capstan pulleys 110 and with each pulley freely rotatable relative to the other through the use of ball bearings 112 as shown in FIG. 7. Each pulley has an individual wire 44 wrapped around the pulley approximately one to two times and with the wire received within a grooved portion 114. Each pulley 110 also includes a gear portion 116 for engagement with a drive gear 118 shown in FIGS. 5 and 6.

The drive gear 118 is movable relative to the individual pulleys 114 through the use of a slide assembly 120 which slide assembly is slideable on a pair of shafts 122 and 124. The slide assembly 120 is driven along the plurality of pulleys 110 through the use of a helically threaded rod 126 and with the slide assembly including a follower 128. The helically threaded rod 126 is freely rotatable and is rotated using a motor 130 which is coupled to the end 132 of the helically threaded rod 126. As the rod 126 is rotated, the follower 128 is moved longitudinally to position the gear 118 in engagement with a desired one of the pulleys 110.

The pulleys 110, as indicated above, are freely rotatable using ball bearings 112 which are mounted on shaft 134. The gear 118, when engaging a desired one of the gear portions 116 of an individual one of the pulleys 110, is rotated by a motor 136 to provide rotation of the pulley. The motor 136 may be an air operated motor and is moved longitudinally with the slide assembly 120. In order to assure proper positioning of the drive gear 118 relative to an individual one of the pulleys 110, the shaft 122 may include a plurality of detents 138. The slide assembly 120 may include a complementary feeler member, such as an electrical switch 140, to determine when the slide assembly 120 is properly positioned over a detent.

Figure 8:
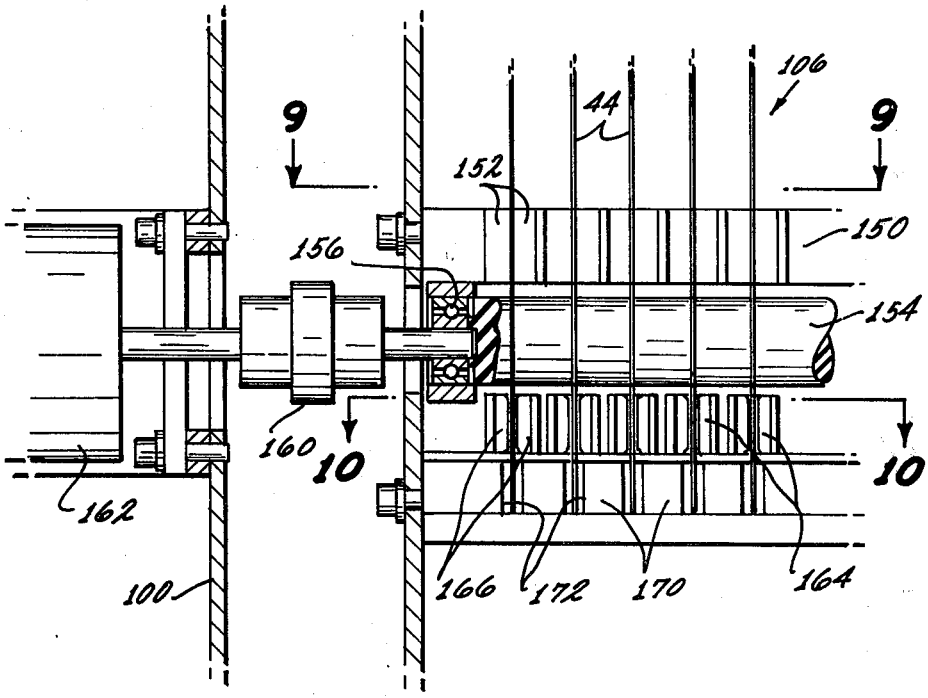
FIG. 8 is a detail view of the wire feed and clamp subassembly.
Figure 9:
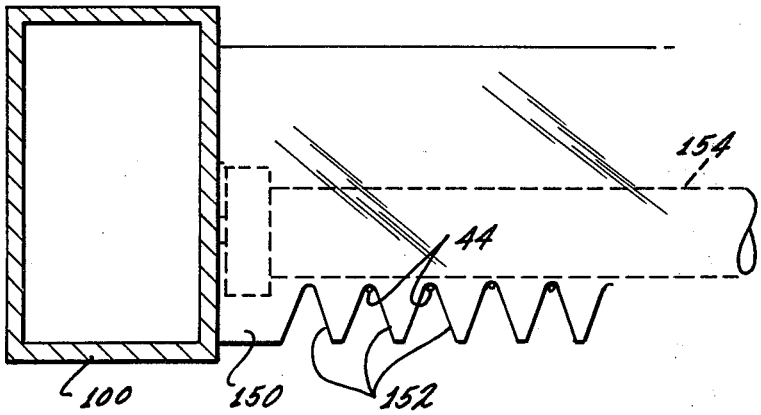
FIG. 9 is a top view of the wire feed and clamp assembly taken along lines 9—9 in FIG. 8.
Figure 10:
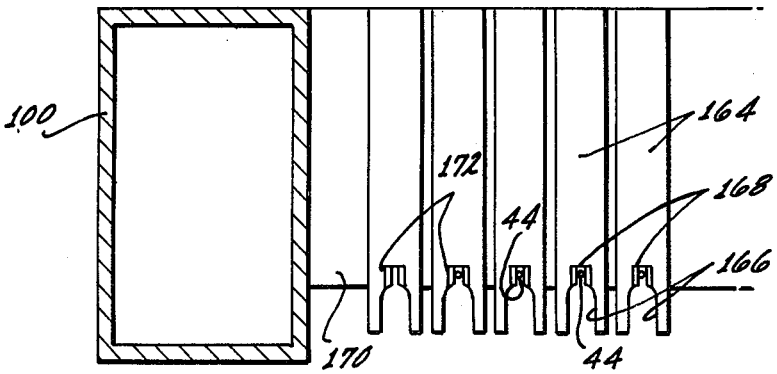
FIG. 10 is a top view of the wire feed and clamp subassembly taken along lines 10—10 of FIG. 8.

FIG. 4 illustrates a front view of the wire feed and clamp assembly 106 and FIG. 8 illustrates a detail view of the assembly 106. FIGS. 9 and 10 illustrate top views of the wire feed and clamp assembly 106 taken along lines 9—9 and 10—10 respectively.

The wire feed and clamp assembly 106 includes an upper wire guide 150 which includes a plurality of the slots 152 to guide the wires 44. The individual wires 44 then pass downward over a wire feed roller 154. The roller 154 is supported for rotation at opposite ends by ball bearings 156 and 158 and with a drive shaft 160 extending from one end. A motor 162 is used to rotate the shaft 154 so that individual ones of the wires 44, when held by a pressure roller against the roller 154, may be moved either upward or downward.

The individual wires 44 pass downward to be individually clamped by clamping bars 164. The clamping bars include a U-shaped portion 166 which U-shaped portion is used to receive a spreading roller to release an individual wire 44 from a clamping jaw portion 168. The individual wires 44 are normally clamped by the jaw portion 168 until a roller engages the U-shaped portion 166 to spread the jaw portion 168 to allow for free movement of the wire 44.

A guide block 170 includes guide slots 172 to act as a lower guide for the wire 44 during movement of the wire. A clearer understanding of the operation of the wire feed and clamp assembly will be had when the wire feed head 14 shown in FIG. 11 is described in greater detail.

Returning now to FIG. 4 the wire bar clamp assembly 108 is shown to include a plurality of solenoids 180 so as to clamp the ends of the individual ones of the wires 44 during the initial laying of the wires over the form board 24 as shown in FIG. 1. FIG. 14 illustrates a cross-sectional view of the wire bar clamp assembly at one position and the solenoid 180 is shown to be spring loaded by spring member 182 in an open position. A bar clamp 184 is controlled by the solenoid 180 to be either in the position shown by the solid line in FIG. 14 or by the dotted lines in FIG. 14. The wire 44 passes through a cone-shaped opening 186 in the wire bar clamp 108 and when the solenoid 180 is activated the wire bar clamp 184 is in the dotted position so as to clamp the wire 44 in position. It can be seen that the front of the wire bar clamp 184 has an acute angle so that the wire is not only clamped but is also slightly pinched so as to lock the wire 44 securely in position.

FIGS. 11, 12, and 13 illustrate the wire feed head 14 when in the position to engage the wire feed and clamp assembly 106. The wire 44 passes downward through the V slot 152 in the upper wire guide 150 as shown in more detail in FIG. 9, and by the wire feed roller 154 and is then normally clamped in the wire clamp jaw portion 168 of the clamps 164 as shown in more detail in FIG. 10. When the wire feed head 14 is in the position adjacent the wire feed and clamp assembly 106, a roller 200 is used to engage the walls of the U-shaped portion 166 of the clamp 164. This roller 200 spreads the clamp and specifically the jaw portion 168 so that the wire 44 may be moved in an upward or downward position upon actuation of the wire feed roller 154. The roller 200 may be actuated to engage clamp 164 through the use of an air piston 202. It is to be appreciated then that an electrical solenoid may also be used to actuate the roller 200 to move in and out of engagement with the wire clamp 164.

The wire 44 is pinched for movement by the use of a pinch roller 204. The pinch roller is spring loaded in a direction towards the roller 154 by spring mechanism 206. When the wire 44 is pinched between the pinch roller 204 and the feed roller 154 any rotation of the roller 154 causes motion of the wire 44 in an upward or downward direction in accordance with the direction of rotation of the roller 154. A plunger 208, which is spring loaded in an outward direction by spring member 210, is used to close off the front face of the lower guide opening 172. This ensures that when the wire is being fed either upward or downward it is properly maintained within the opening 172.

When the wire feed member 14 is pulled away from the wire feed and clamp assembly 106, the roller 204, the roller 200, and the plunger 206 are no longer operative and do not function in the actual laying of the wire over the form board 24 as shown in FIG. 1. The wire 44 passes through a funnel-shaped opening 212 which tapers downward and inward to guide the wire 44 into the head 14 and to be freely slideable through the opening 216. A roller 214 also provides for the wire 44 to freely slide through the opening 212.

The wire 44 passes through an opening 216 which has positioned along its length a spring loaded clamp plunger 218. The plunger 218 is normally biased away from the wire 44 but an air operated piston 220 may be actuated to move the clamp 218 to clamp the wire 44 within the opening 216. It is to be appreciated that the plunger 218 may also be operated by a solenoid.

The wire 44 passes downward through a pair of funnel-shaped openings 222 and 224. These openings are funnel-shaped to guide the wire in a downward direction. Intermediate the two funnel-shaped openings 222 and 224 is a wire cutter 226. The wire cutter is spring biased by spring member 228 to be in a position away from the wire 44. The cutter 226 may be actuated by an air operated plunger 230 to move outwardly to cut the wire 44. It is to be appreciated that the plunger 230 may be solenoid controlled rather than air operated.

The wire 44 now passes downward through a wire presence sensor which includes a light source 232 and a light detector 234. The light source, for example, may be an LED and the light detector may be a phototransistor or combination thereof. When the wire 44 is present, the light detector 234 detects a particular light level. When the wire is absent, the light impinging on the detector 234 increases to indicate the absence of the wire 44.

The wire 44 continues to pass downward through a funnel-shaped opening 236 in a swivel ball 238. A tubular member 240 including a flexible helical spring 241 at its end extends from the swivel ball 238 to guide the wire down to the position for laying the wire on the form board. The end of the tube 240 is recessed and the spring 241 is twisted on the recessed end and up against the shoulder formed by the recess. A smooth bushing 243 is formed at the end of the spring 241 and the bushing may be a separate member or may be integral with the spring by brazing together four or five spring coils. The wire 44 is gently bent by the spring 241 as shown by the dotted line portion as the wire is being laid.

The swivel ball 234 is recessed in a complementary opening in a swivel plate 242. The swivel plate 242 is pivoted at position 244 and is held in position by a series of flat springs 246 which are bolted to the wire feed head 14 using bolt member 248. If the wire 44 passing through the tube 240 is overtensioned during laying, this would put force on the end of the tube 240 so as to swivel the swivel ball 238 in the opening in the plate 240. The spring 248 allows the swivel plate to rock around the pivot 244 and thereby relieve the tension. A microswitch 250 senses the end position of the swivel plate through a plunger 252. If the wire 44 is overtensioned so that the ball 238 is swiveled, this allows the plate 242 to move downward, thereby opening the microswitch 250. The opening of the microswitch provides for a sensing of overtension in the wire 44.

In place of the swivel tube 240, the feed tube for the wire 44 may take the form shown in FIG. 11*a*. In FIG. 11*a*, an inner tube 254 extends from the swivel ball 238 in the same manner as tube 240. An outer tube member 256 is freely rotatable around tube 254 but is held in position through the use of bearings 258. The end of the tube 256 is flared outwardly as shown by end portion 260. A roller member 262 is used to guide the wire 44 and to insure that the wire is smoothly bent down to the form board. The feed tube shown in FIG. 11*a* has particular utility for wires 44 which are larger in diameter since it provides for a smooth bend of the wire, but it is to be appreciated that the form of the feed tube shown in FIG. 11*a* is also used for all wires rather than for just large diameter wires.

The wire feed head 14 shown in FIG. 11 not only operates in an X-Y direction as shown in FIG. 1, but the wire feed head 14 also includes a Z drive which can move the drive head up or down along a feed drive shaft 264. The movement either up or down along the Z drive shaft 264 may be controlled by a ball screw drive member 266 which passes through the follower member 268. The wire feed head 14 is connected to the follower member 268 to provide for movement in the Z direction. The rotation of the ball screw drive member 266 may be controlled by a stepper motor 270 which drives the ball screw member through the use of a belt 272. The belt may be held in position through the use of roller members 274 and 276. The movement of the wire feed head 14 in the Z direction provides for the proper positioning of the wire feed tube over the form board. For example, as the cable is being laid, successive ones of the individual wires may be laid at progressively higher positions relative to the form board. This compensates for the increasing thickness of the cable as it is being laid.

FIG. 15 illustrates a flow chart of the operation of the automatic cable forming system shown in FIGS. 1 through 14. Initially, the cable forming system is set up with wires 44 by threading each wire from its spool 40 around a pulley 46 and continuing around an individual capstan pulley 110 and down to the wire feed and clamp assembly 106. Each wire is then clamped in position by the jaws 168 of its respective clamp 164. After all of the wires are set up, the programmer 10 is activated to control the capstan drive 126 to move the slide assembly 120 so that the drive gear 118 is at a position No. 1 to engage a first one of the capstan pulleys. The capstan drive motor 136 is then controlled to operate at a low speed.

The feed head 14 is also indexed to a position No. 1 and is essentially in the same relative position as shown in FIG. 11 where the head 14 is positioned adjacent the wire feed and clamp assembly 106. At this time, the wire 44 is engaged between the spring roller 204 and the feed roller 154. The wire clamp opening roller 200 is moved forward to open the wire holding clamp 164. The wire feed roller 154 is then actuated which threads the wire through the wire head 14 and down to the wire bar clamp 108 and specifically through the opening 186 in the wire bar clamp 108 shown in FIG. 14. The roller 154 is then deactivated, and the solenoid 180 is activated so as to clamp the wire 44 as shown by the dotted position in FIG. 14.

The capstan drive 136 is now controlled to operate at high speed so that the gear 118 moves the individual capstan pulley 110 at high speed. As the capstan drive is operated at high speed, the wire head 14 is moved away from position No. 1 and the wire 44 is moved out of the jaw 168 of the clamp 164 before the wire clamp opening roller 200 disegages the clamp 164. The wire head 14 moves the wire 44 to wrap the wire around the first pin 36 as shown in FIG. 1. After the wire 44 has been wrapped around the first pin 36 and is now secured at an end position on the form board, the solenoid 180 and wire bar clamp 108 open since it is no longer necessary to clamp the wire and to maintain the solenoid in the activated position. The wire head 14 is now programmed to continue laying the wire 44 on a predetermined path through the pattern of pins 26 on the form board 24 until the end position is reached. At that time, the wire head 14 wraps the wire 44 around a final one of pins 26.

After the wire 44 has been wrapped around the final pin, the capstan motor and specifically the gear 118 is moved to the next capstan position to engage the next roller 110 and at the same time the wire head 14 is then stopped. The wire head clamp 218 is activated to clamp the wire 44 within the opening 216 in the wire head 14. The wire head cutter 226 is then activated to cut the wire and the cutter is then deactivated.

After the wire 44 is cut so that the end of the wire remains on the form board, the wire head is then returned to the original index position No. 1 adjacent the wire feed and clamp assembly 106. As the wire head returns, the partially wound spring 92 which is part of the spring assembly of the spool 40 takes up the slack in the wire as the wire head 14 moves back towards the spool array and to the index position No. 1. With the wire head 14 back at the index position No. 1, the wire 44 is again engaged between the spring roller 204 and the wire feed roller 154. The wire clamp opening roller 200 is activated to open the jaws 168 of the wire holding clamp 164. Also the wire head wire clamp plunger 218 is deactivated to free the wire 44 within the wire head 14.

Once the wire 44 is freed from within the wire head 14, the wire feed roller 154 is activated in a reverse direction to extract the wire 44 from the wire head 14. Once the wire 44 has been extracted so that its end is within the opening 172 in the lower guide 170, the wire clamp opening roller 200 is deactivated so that the jaws 168 of the wire holding clamp 164 close to clamp the end of the wire 44 back at its original position. The laying of the first wire on the form board 24 is now complete and the wire head 14 is backed away and moved to the next position. The capstan, of course, had been previously indexed to the next position and the system is now ready to repeat the process as shown in FIG. 15 with the next wire. This process is continuously repeated until all of the wires are laid and with the path of each individual wire controlled by a predetermined program stored within the programmer 10.

As an alternative to the use of the wire bar clamp 38, the form board 24 may include the individual clamps 28 and with the end of the wire 44 clamped initially by a clamp 28 before being laid over the form board. The wire 44 would be clamped within the head 14 by the clamp plunger 218 while the wire is carried to the position of the clamp 28.

Although the invention has been described with reference to a particular embodiment, it is to be appreciated that various adaptations and modifications may be made and the invention is only to be limited by the appended claims.

I claim:

1. An automatic cable forming system incorporating an X-Y positioner for automatically laying a plurality of individual wires in a predetermined pattern to form a complex cable, including an array of individual spools each including a tensioning device to produce a predetermined tension on a wire as it is unspooled, a plurality of individual capstan pulleys each receiving an individual wire from one of the spools, a single capstan drive for engaging one capstan pulley at a time for individually feeding the plurality of wires from the spools, a plurality of individual clamps for clamping the plurality of individual wires except the wire fed from the capstan pulley engaged by the capstan drive, and a single wire head coupled to the X-Y positioner for receiving the wire fed from the capstan pulley engaged by the capstan drive for laying the wire in a predetermined pattern and with the single wire head individually receiving each one of the plurality of wires as each wire is fed from its capstan pulley for laying the pulurality of wires in the predetermined pattern to form the complex cable.

2. The automatic cable forming system of claim 1 wherein the array of individual spools are individually arranged on pallets and with the individual wires guided by overhead pulleys to the capstan pulleys.

3. The automatic cable forming system of claim 1 wherein the tensioning device includes a spring mechanism coupled to a clutch which slips at a predetermined force and with the spring mechanism partially wound to produce the predetermined force to produce the predetermined tension.

4. The automatic cable forming system of claim 3 wherein the partially wound spring mechanism providing for respooling of slack wire during the operation of the system.

5. The automatic cable forming system of claim 1 wherein the plurality of individual capstan pulleys are mounted for free rotation on a common shaft and with each capstan pulley including a recessed portion for containing at least one turn of the wire and with each capstan pulley including a portion engaged by the capstan drive for providing driven rotation about the common shaft.

6. The automatic cable forming system of claim 5 wherein the capstan drive is a rotary drive gear movable longitudinally relative to the common shaft and with the portion of each capstan pulley engaged by the capstan drive a gear portion complementary to the drive gear.

7. The automatic cable forming system of claim 6 wherein the rotary drive gear is supported by a slide mechanism for longitudinal movement and with the slide mechanism including detents for aligning the drive gear with each gear portion of the capstan pulleys.

8. The automatic cable forming system of claim 1 wherein the individual clamps each include jaws for receiving and clamping the individual wires and with each clamp including arm portions for spreading the jaws and with the wire head including wire clamp opening means for engaging the arm portions to spread the jaws and release the individual wire.

9. The automatic cable forming system of claim 8 wherein the arm portions form a U-shaped opening with the jaws at the closed end of the U-shaped opening and wherein the wire clamp opening means is a roller for engaging the inner walls of the U-shaped opening.

10. The automatic cable forming system of claim 8 wherein the wire clamp opening means is movable to engage the clamp to release the wire and to disengage the clamp to clamp the wire.

11. The automatic cable forming system of claim 1 additionally including a wire feed mechanism intermediate the capstan pulley and the wire head for additionally feeding the wire from the capstan pulley through the wire head.

12. The automatic cable forming system of claim 11 wherein the wire feed mechanism includes a rotary driven wire feed roller extending across the plurality of wires intermediate the plurality of capstan pulleys and the plurality of wire clamps and with the wire head including a pinch roller for pinching individual ones of the wires between the pinch roller and the feed roller for providing longitudinal movement of individual ones of the wires.

13. The automatic cable forming system of claim 11 additionally including guide members located above the wire feed mechanism and below the wire clamps and with each of the guide members including a separate guide slot for each wire to guide each wire from its capstan pulley to the wire feed mechanism and from the wire clamp to the wire head.

14. The automatic cable forming system of claim 1 wherein the wire head includes a funnel-shaped opening with a roller at the front of the opening for providing a smooth flow of wire to the wire head during laying of the wire in the predetermined pattern.

15. The automatic cable forming system of claim 1 wherein the wire head includes a clamp within the head for clamping the wire within the head.

16. The automatic cable forming system of claim 1 wherein the wire head includes a cutter for cutting the wire within the head.

17. The automatic cable forming system of claim 1 wherein the wire head includes a feed tube extending from the bottom of the head for feeding the wire during laying and with the feed tube including an upper rocker assembly coupled to a spring loaded pivoted plate for providing a rocking of the feed tube and a pivoting of the plate when the tension on the wire extending from the feed tube exceeds a predetermined level.

18. The automatic cable forming system of claim 17 additionally including a wire tension sensor for detecting the pivoting of the plate.

19. The automatic cable forming system of claim 1 additionally including a feed tube extending from the bottom of the wire head for feeding the wire during laying and with the feed tube including a bottom spring for gently guiding the wire.

20. The automatic cable forming system of claim 1 additionally including a feed tube extending from the bottom of the wire head for feeding the wire during laying and with the feed tube including a flared bottom and including a roller for guiding the wire.

21. The automatic cable forming system of claim 1 wherein the wire head includes a wire presence detector.

22. The automatic cable forming system of claim 1 additionally including a plurality of wire end clamps for individually clamping one end of each of the plurality of wires and with the wire received by the wire head fed through the wire head and clamped by one of the wire end clamps before the wire is laid in the predetermined pattern.

23. The automatic cable forming system of claim 22 wherein the wire end clamps are formed as a plurality of stations along a wire bar clamp located below the plurality of individual clamps.

24. The automatic cable forming system of claim 22 wherein the cable is laid over a form board and with at least some of the wire end clamps located at predetermined locations on the form board.

25. The automatic cable forming system of claim 1 wherein the wire head includes a Z drive for providing movement of the wire head in the Z direction to adjust the position of the laying of the wires in the Z direction.

26. An automatic cable forming system incorporating an X-Y positioner for automatically laying a plurality of individual wires in a predetermined pattern to form a complex cable, including an array of individual spools of wires and with each spool including a tensioning device to produce a predetermined tension on a wire as it is unspooled, an open framework extending above the array of spools and with the framework including a plurality of individual pulleys for guiding the wires to the X-Y positioner, a capstan drive for receiving the individual wires from the individual pulleys and for individually feeding the plurality of wires from the spools, a plurality of individual clamps for clamping the plurality of individual wires, means coupled to the plurality of individual clamps for releasing one wire at a time from the individual clamps, a single wire head coupled to the X-Y positioner and with the single wire head individually receiving each one of the plurality of wires as each wire is released from its individual clamp and with the single wire head laying the plurality of wires in the predetermined pattern to form the complex cable.

27. The automatic cable forming system of claim 26 wherein the array of individual spools are additionally arranged on pallets and with the central axis of spools perpendicular to the pallets and with the tensioning device including an arm rotatable about the central axis for guiding the wire from the spool to its individual pulley.

28. The automatic cable forming system of claim 26 wherein the tensioning device includes a spring mechanism coupled to a clutch which slips at a predetermined force and with the spring mechanism partially wound to produce the predetermined force to produce the predetermined tension.

29. The automatic cable forming system of claim 28 wherein the partially wound spring mechanism providing for respooling of slack wire during the operation of the system.

30. The automatic cable forming system of claim 26 wherein the individual clamps each include jaws for receiving and clamping the individual wires and with each clamp including arm portions for spreading the jaws and with the means for releasing the wires formed as part of the wire head and with the means for engaging the arm portions to spread the jaws and release the individual wire.

31. The automatic cable forming system of claim 30 wherein the arm portions form a U-shaped opening with the jaws at the closed end of the U-shaped opening and wherein the means for releasing the wires is a roller for engaging the inner walls of the U-shaped opening.

32. The automatic cable forming system of claim 30 wherein the means for releasing the wire is movable to engage the clamp to release the wire and to disengage the clamp to clamp the wire.

33. An automatic cable forming system incorporating the X-Y positioner for automatically laying a plurality of individual wires in a predetermined pattern to form a complex cable, including a plurality of individual spools of wire, a plurality of individual capstan pulleys each receiving an individual wire from one of the spools and with the plurality of capstan pulleys mounted for free rotation on a common shaft and with each pulley containing at least one turn of the wire, a single capstan drive for engaging one capstan pulley at a time for individual rotation of each pulley for individually feeding the plurality of wires from the spools, and a single wire head coupled to the X-Y positioner for receiving the wire fed from the capstan pulley engaged by the capstan drive for laying the wire in a predetermined pattern and with the single wire head individually receiving each one of the plurality of wires as each wire is fed from its capstan pulley for laying the plurality of wires in the predetermined pattern to form the complex cable.

34. The automatic cable forming system of claim 33 wherein the plurality of individual castan pulleys include a recessed portion for containing the at least one turn of the wire and with each capstan pulley including a portion engaged by the capstan drive for providing driven rotation about the common shaft.

35. The automatic cable forming system of claim 34 wherein the capstan drive is a rotary drive gear movable longitudinally relative to the common shaft and with the portion of each capstan pulley engaged by the capstan drive a gear portion complementary to the drive gear.

36. The automatic cable forming system of claim 35 wherein the rotary drive gear is supported by a slide mechanism for longitudinal movement and with the slide mechanism including detents for aligning the drive gear with each gear portion of the capstan pulleys.

37. An automatic cable forming system incorporating an X-Y positioner for automatically laying a plurality of individual wires in a predetermined pattern to form a complex cable, including a plurality of individual spools of wire, a plurality of individual capstan pulleys each receiving an individual wire from one of the spools, a single capstan drive for engaging one capstan pulley at a time for individually feeding the plurality of wires from the spools, and a wire feed mechanism for receiving the plurality of wires and for feeding the wire from the capstan pulley engaged by the capstan drive, and a single wire head coupled to the X-Y positioner for receiving the wire fed from the wire feed mechanism for feeding the wire through the wire head.

38. The automatic cable forming system of claim 37 wherein the wire feed mechanismm includes a rotary driven wire feed roller extending across the plurality of wires intermediate the plurality of capstan pulleys and the wire head and with the wire head including a pinch roller for pinching individual ones of the wires between the pinch roller and the feed roller for providing longitudinal movement of individual ones of the wires.

39. The automatic cable forming system of claim 37 additionally including guide members located above the wire feed mechanism and above the wire head and with each of the guide members including a separate guide slot for each wire to guide each wire from its capstan pulley to the wire feed mechanism and from the wire feed mechanism to the wire head.

40. An automatic cable forming system incorporating an X-Y positioner for automatically laying a plurality of individual wires in a predetermined pattern to form a complex cable, including a plurality of individual spools of wire, a plurality of individual capstan pulleys each receiving an individual wire from one of the spools, a single capstan drive for engaging one capstan pulley at a time for individually feeding the plurality of wires from the spools, a clamp mechanism for clamping the plurality of individual wires except the individual wire fed from the capstan pulley engaged by the capstan drive, and a single wire head coupled to the X-Y positioner for receiving the wire fed from the capstan pulley engaged by the capstan drive for laying the wire in a predetermined pattern and with the single wire head individually receiving each one of the plurality of wires as each wire is fed from its capstan pulley for laying the plurality of wires in the predetermined pattern to form the complex cable.

41. The automatic cable forming system of claim 40 wherein the wire head includes a funnel-shaped opening with a roller at the front of the opening for providing a smooth flow of wire to the wire head during laying of the wire in the predetermined pattern.

42. The automatic cable forming system of claim 40 wherein the wire head includes a clamp within the head for clamping the wire within the head.

43. The automatic cable forming system of claim 40 wherein the wire head includes a cutter for cutting the wire within the head.

44. The automatic cable forming system of claim 40 wherein the wire head includes a feed tube extending from the bottom of the head for feeding the wire during laying and with the feed tube including an upper rocker assembly coupled to a spring loaded pivoted plate for providing a rocking of the feed tube and a pivoting of the plate when the tension on the wire extending from the feed tube exceeds a predetermined level.

45. The automatic cable forming system of claim 44 additionally including a wire tension sensor for detecting the pivoting of the plate.

46. The automatic cable forming system of claim 40 additionally including a feed tube extending from the bottom of the wire head for feeding the wire during laying and with the feed tube including a bottom spring for gently guiding the wire.

47. The automatic cable forming system of claim 40 additionally including a feed tube extending from the bottom of the wire head for feeding the wire during laying and with the feed tube including a flared bottom and including a roller for guiding the wire.

48. The automatic cable forming system of claim 40 wherein the wire head includes a wire presence detector.

49. The automatic cable forming system of claim 40 additionally including a plurality of wire end clamps for individually clamping one end of each of the plurality of wires and with the wire received by the wire head fed through the wire head and clamped by one of the wire end clamps before the wire is laid in the predetermined pattern.

50. The automatic cable forming system of claim 49 wherein the wire end clamps are formed as a plurality of individual clamps.

51. The automatic cable forming system of claim 49 wherein the cable is laid over a form board and with at least some of the wire end clamps located at predetermined locations on the form board.

* * * * *